US006206355B1

(12) United States Patent
Lichtenberg

(10) Patent No.: US 6,206,355 B1
(45) Date of Patent: Mar. 27, 2001

(54) CLAMP CLIPS WITH ROTATIONAL AND DISPLACEABLE TENSION ELEMENTS

(75) Inventor: Wilfried Lichtenberg, Haus Hastern 1, D-41812 Erkelenz (DE)

(73) Assignee: Wilfried Lichtenberg, Erkelenz (DE)

( * ) Notice: Subject to any disclaimer, the term of this patent is extended or adjusted under 35 U.S.C. 154(b) by 0 days.

(21) Appl. No.: 09/319,894

(22) PCT Filed: Dec. 15, 1997

(86) PCT No.: PCT/EP97/07036

§ 371 Date: Jun. 14, 1999

§ 102(e) Date: Jun. 14, 1999

(87) PCT Pub. No.: WO98/25732

PCT Pub. Date: Jun. 18, 1998

(30) Foreign Application Priority Data

Dec. 13, 1996 (DE) ..... 196 52 057

(51) Int. Cl.[7] ..... B25B 1/00

(52) U.S. Cl. ..... 269/156; 269/217; 269/233; 269/258; 269/266; 269/268; 269/902

(58) Field of Search ..... 269/156, 217, 269/233, 258, 266, 268, 902, 299, 305, 45, 910, 96, 102.1

(56) References Cited

U.S. PATENT DOCUMENTS 5,350,163 * 9/1994 Lichtenberg ..... 269/258

FOREIGN PATENT DOCUMENTS 8800392 3/1988 (DE) .
8800461 3/1988 (DE) .
8807182 8/1988 (DE) .
0267982 5/1988 (EP) .
0310936 4/1989 (EP) .
2254282 10/1992 (GB) .
9112114 8/1991 (WO) .

* cited by examiner

*Primary Examiner*—Robert C. Watson
(74) *Attorney, Agent, or Firm*—Greer, Burns & Crain, Ltd.

(57) ABSTRACT

A clamp (10) having at least one clamping assembly (11) comprising a base plate (17) and a pair of tension elements (14, 15), the base plate (17) including a pair of oblong holes (16) which converge towards a central line, each of the two tension elements (14, 15) being fully or partially curved at its peripheral face, the peripheral face being made of a skidproof "non-slip" material, a respective tension element (14, 15) being mounted in a respective one of the two oblong holes (16) and positioned such as its axis is substantially perpendicular Lo the base plate (17), the tension elements (14, 15) furthermore being arranged, such that the curved peripheral faces thereof are exactly opposed to each other, and the tension elements (14, 15) being slidable in their respective oblong holes (16) by means of a common slider (155), and wherein they are rotatably seated by means of ball bearings (20), such that they can freely rotate about their own longitudinal axis, wherein, on one hand, the distance between both opposing peripheral faces of the tension elements (14, 15) can be varied by sliding thereof in the oblong holes (16), and wherein, on the other hand, the aforesaid distance can also be varied by rotation of the tension elements (14, 15) via the ball bearings from a first position to a second position, a spring means (39) being provided between the tension elements (14, 15) which is tensioned by the movement of the tension elements (14, 15) in the direction of divergence of the oblong holes (16).

23 Claims, 5 Drawing Sheets

SECTION A-B

CLAMP CLIPS WITH ROTATIONAL AND DISPLACEABLE TENSION ELEMENTS

The present invention relates to a clamp according to the preamble of patent claim , and in particular to a clamp for holding rigid workpieces. The invention has been developed primarily for use as a clamp in the wood-processing industry and the description hereinafter is set forth in such context. However, it should be appreciated that the invention is not limited to this particular field of use and it may be used for supporting or clamping any of a range of rigid workpieces.

In the past, various clamping devices have been proposed for clamping or supporting workpieces. For instance, the vice is a tool which is widely used and consists in essence of two steel plates which are drawn together by a lead screw. While the vice is effective for holding a single workpiece, or for holding parallel workpieces, it is not versatile in that the device cannot adequately cater to asymmetrical or irregular shaped workpieces.

U.S. Pat. No. 4,767,110 discloses a modified vice arrangement to cater for irregular shaped workpieces. This patent discloses a work table incorporating two vice jaws. Each of the two vice jaws incorporates a plurality of connection holes. At least three tension elements are removably secured to the connection holes of the vice jaws. The tension elements are arranged such that one of the tension elements is located in one of the jaws where the other two tension elements are located in the second jaw. The tension elements are secured to the connection holes via shanks and these shanks are eccentrically located on the tension elements. In this way, the respective tension elements can be independently moved out of respective connection holes and inserted at a different location to provide longitudinal adjustability of the tension elements independent of both vice jaws. The tension elements are further rotatably secured by means of the shaft, whereby an individual angular adjustment of the tension elements is made possible.

With this arrangement it is possible that a workpiece is clamped by firstly locating the tension elements in appropriate connection holes such that they are as close to the workpiece as possible. The vice jaws are then brought together and at least some of the tension elements are positioned until such time that all individual tension elements apply a force on the workpiece. To assist in rotation of the tension elements, each claw is provided with a lever.

Although this arrangement does enable greater flexibility of the type of workpieces which can be clamped, it does have the limitation that it is required to be located on a workbench and furthermore a rapid adjustment of the tension elements is not possible. Moreover, the actual handling of the workpiece is difficult in that it is necessary to bring the vice jaws together, while a pressure must be applied simultaneously on each lever at the tension elements. In order to ensure that the tension elements grip the workpiece safely, a force normal to the contact surface must be applied. This normal force is necessary if there is not sufficient frictional force between the workpiece and the tension element to prevent the workpiece from merely sliding between the two tension elements, without causing a rotation of the tension elements which would be of use for clamping.

EP-A 0 267 982 discloses a clamp, wherein the tension elements have to be manually positioned in order to reach the working position. In this working position the tension elements are exactly opposite with respect to one another. Accordingly, the user of the prior art clamp has to position the tension elements with two hands so that the user cannot simultaneously operate the clamping screw by means of the handle.

From EP-A-0 513 117 there is further known a clamp in accordance with the preamble of patent claim 1. With this clamp the user is enabled to move out both tension elements of a clamping assembly by means of a slider in order to position a workpiece between the tension elements. Subsequently both of the tension elements are moved back as far as possible by actuating the slider. At the subsequent clamping of the workpiece by actuating the threaded spindle, a pressure must be simultaneously applied on the slider by the other hand during an initial phase.

It is the object of the present invention to increase the handling comfort for the user compared to the aforementioned clamps by reducing the number of the necessary working steps.

A further object of the present invention is the provision of a clamp with automatic self-positioning and self-adjusting tension elements.

A further object of the invention is the provision of a clamp having tension elements capable of frictionally holding a workpiece prior to the actual clamping operation, without the need for additional forces to be applied by the user.

These and further objects which will be apparent from the following description are achieved by the clamp of present invention, as set forth in claim 1.

The clamp of the present invention comprises at least one clamping assembly having at least two tension elements which are slidably arranged in converging oblong holes, such that rotation of the tension elements from one position to a second position is not hindered.

Between the tension elements of the clamping assembly there is provided a spring means, which is tensioned by movement of the tension elements within the oblong holes. A restoration force, based on the spring means, acts on the tension elements in order to relocate the tension elements always to the initial position following a linear movement of the tension elements within the oblong hole.

Preferably each tension element is oval shaped in cross section, wherein the cross section runs perpendicular to its axis of rotation. Alternatively, each tension element is shaped as a modified three-cornered rod, wherein the cross section is of triangular shape. Also in this case the cross section runs perpendicular to the longitudinal axis of the tension element. This modified three-cornered rod has a curved peripheral face extending laterally from one edge to the opposite edge, and each of this curved peripheral faces is formed from a different material. Thereby three peripheral faces are provided, each of the faces having different hardness, flexibility or surface texture.

Furthermore, it is preferable that each tension element is conical in shape in the direction of its longitudinal axis, whereby the tapered end of the cone is positioned in close proximity to the oblong holes. The opening angle of the cone is 1–2 degrees, preferably 1.5 degrees. This cone-shape compensates for deformation of the tension elements under load.

Preferably, the clamp according to the present invention includes a second clamping assembly which is moveable in respect to the first one and which serves to exert on the workpiece the force necessary for clamping to thereby move the workpiece in the direction of convergence of both oblong holes.

Preferably the second clamping assembly according to the present invention consists of a steel plate which is connected to a threaded spindle. The threaded spindle is located in a corresponding counterpart. In this way the second clamping assembly is capable of linear movement by rotation of the threaded spindle.

Alternatively, the second clamping assembly is the same in structure as the first clamping assembly. In this arrangement, the connecting elements of the two clamping assemblies are secured at a respective end of a coupling element which enables the relative movement of the first clamping assembly towards the second clamping assembly. The coupling element may consist of a threaded spindle and a sleeve having a thread on its inner surface. In this way rotation of the sleeve relative causes linear movement of the first clamping assembly relative to the second clamping assembly.

An advantage of the preferred embodiment of the present invention is that, due to the restoration force acting between the tension elements, a fast and automatic alignment and positioning of the displaceable tension elements is possible at the workpiece to be clamped. Thus, the lateral forces, applied by the tension elements on the workpiece, are provided prior to the actual clamping process due to the fact that a restoring force acts between the tension elements displaced in the oblong holes based on the deflection of the spring means, whereby the restoration force forces back the tension elements in direction of the converging oblong holes. Due to this initial lateral force the tension elements are brought automatically into contact with the workpiece surface, and the workpiece is securely held in position, without slipping. This preferred embodiment allows automatic adjustment of the workpiece, which is positioned in the gap between the tension elements, and thus there is no need for additional pressure on the tension elements in order generate sufficient frictional forces between the tension elements and the workpiece prior to the actual clamping process.

Without any closer reference to further embodiments and constructive forms, which fall within the scope of the claims, the invention will now be described with reference to some of the presently preferred embodiments and to the accompanying drawings in which:

FIG. 6 is a schematic view showing an alternative form of the tension elements, wherein

FIG. 8 is showing a lateral cross section of a tension element (14) according to the present invention, wherein the axis (19) is arranged displaced in respect to the longitudinal direction of the converging oblong hole (16), and wherein

Figure 1:
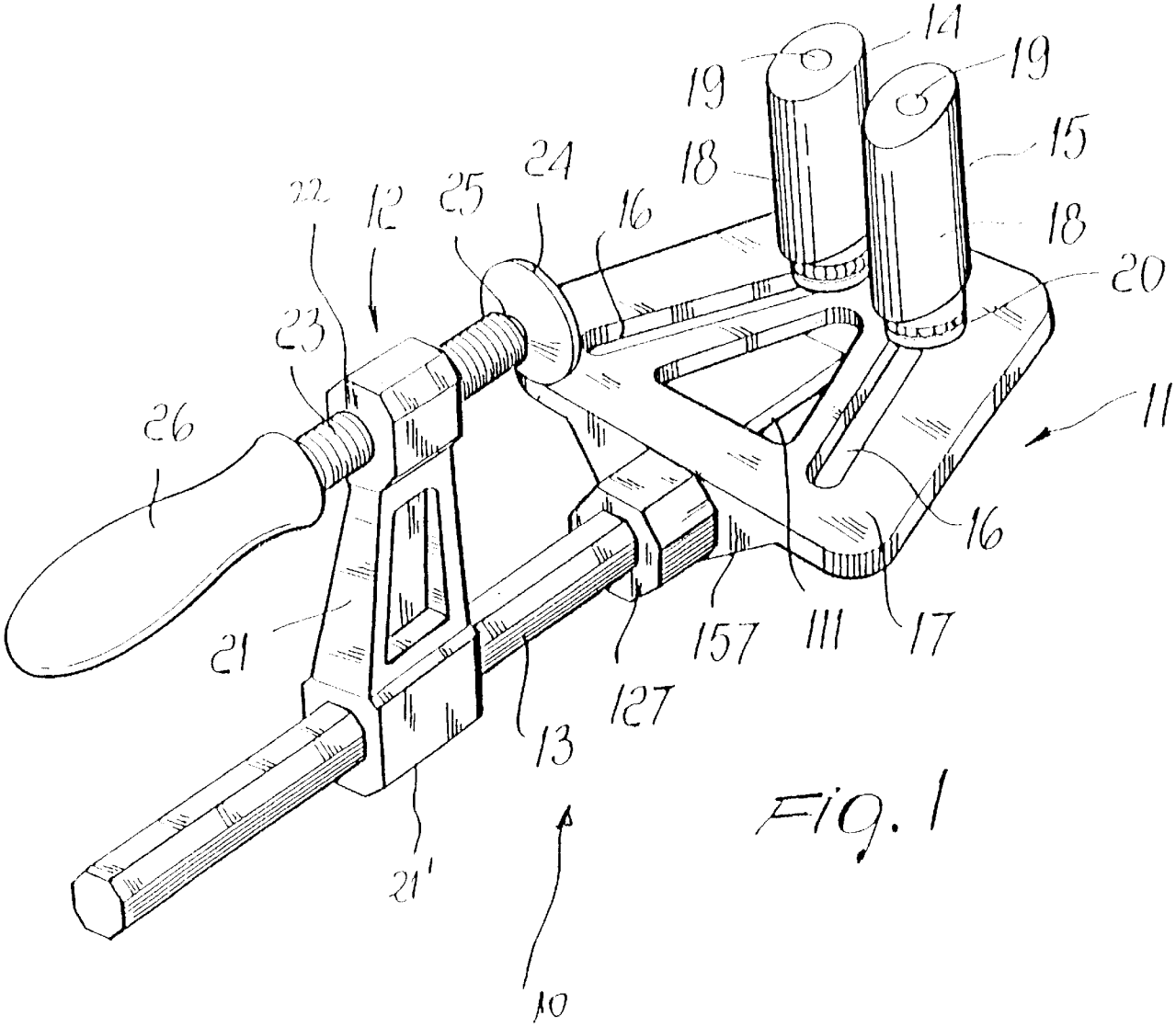
FIG. 1 is a perspective bottom view of a clamp embodying the present invention.
Figure 2:
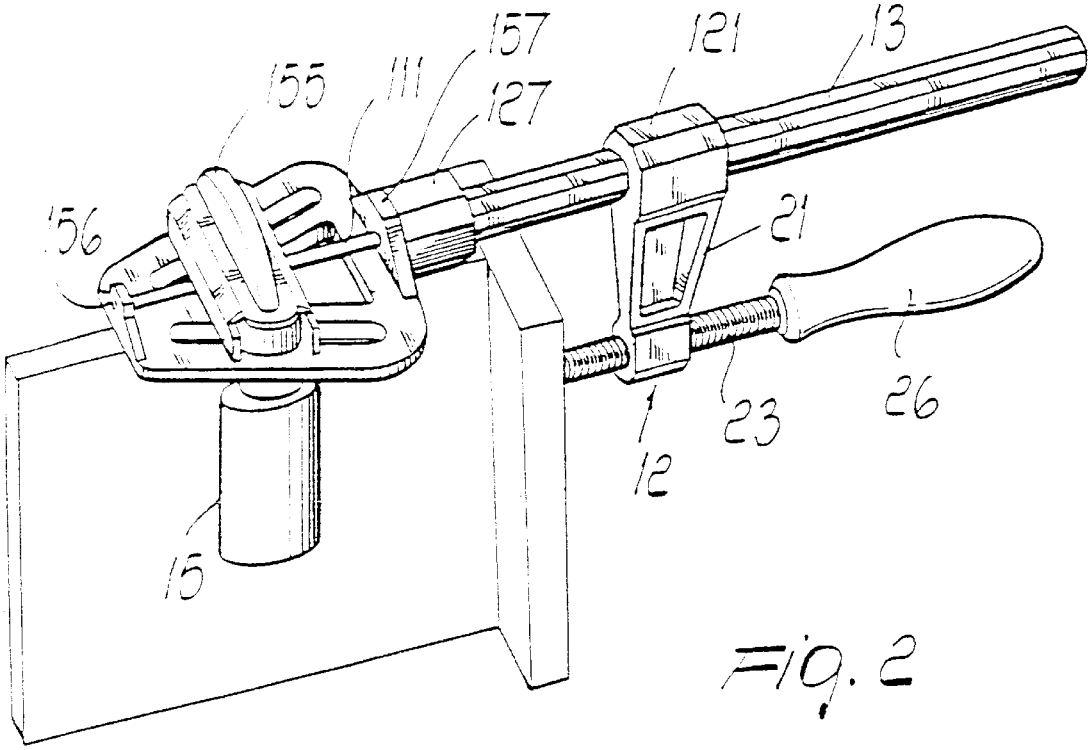
FIG. 2 is a side elevation of the clamp of FIG. 1 showing a workpiece being clamped.

As illustrated in FIGS. 1 and 2, there is shown a clamp (10) with first and second clamping assemblies (11, 12) being interconnected by a rod (13). The rod (13) is preferably a polyhedral rod. This is a particularly advantageous aspect of the present invention because it does provide a defined angular adjustability of the clamping assemblies relative to each other. As a consequence thereof, it is possible to securely clamp workpieces, the clamping parts of which are not perpendicular to one another. This feature can be implemented alone or in combination with the remaining novel advantageous features of the present invention.

The end of the rod (13) is preferably rounded at one end in order to provide rotability of the clamping assembly (12) on the polyhedral rod (13), without the requirement to remove the clamping assembly completely from the rod (12). The rod (13) is widened at end in continuation to the rounding, in order to prevent a slipping of the clamping assembly (12).

As an example the polyhedral rod is embodied as an octagonal rod in FIGS. 1 and 2. The corresponding foot (211) in the bracket (21) may be shaped as an octagon, as shown, or as a hole having sixteen internal edges for accommodating the octagonal rod (13). The latter embodiment advantageously allows an angular adjustability of the tension element (12) in steps of 22,5 degrees.

The first clamping assembly (11) comprises two tension elements (14, 15) which are slidably arranged in respective oblong holes (16) located in a base plate (17). The oblong holes are arranged to converge at an upper end of the base plate (17), remote from the second clamping assembly (12). Preferably the oblong holes form an angle of 40 degrees therebetween.

Each tension element (14, 15) comprises a head part (18) which is rigidly connected to an axle (19) each of which being secured in one of the oblong holes (16). In this way, each of the two tension elements (14, 15) can be easily displaced in spite of the securing to the oblong holes, while the tension elements remain secured to the base plate (17).

In the preferred embodiment the axles (19) of the head part (18) are not centrally positioned in respect to the longitudinal axles of the oblong holes (16) but they are arranged laterally displaced (i.e. eccentric) (refer to FIG. 8), whereby rotation of the tension elements (14, 15) described hereinafter is aided.

Each of the two tension elements is also free to rotate about its axis through 360° relative to the base plate (17). To allow rotation of the tension elements axial ball bearings (20) are provided.

Figure 3:
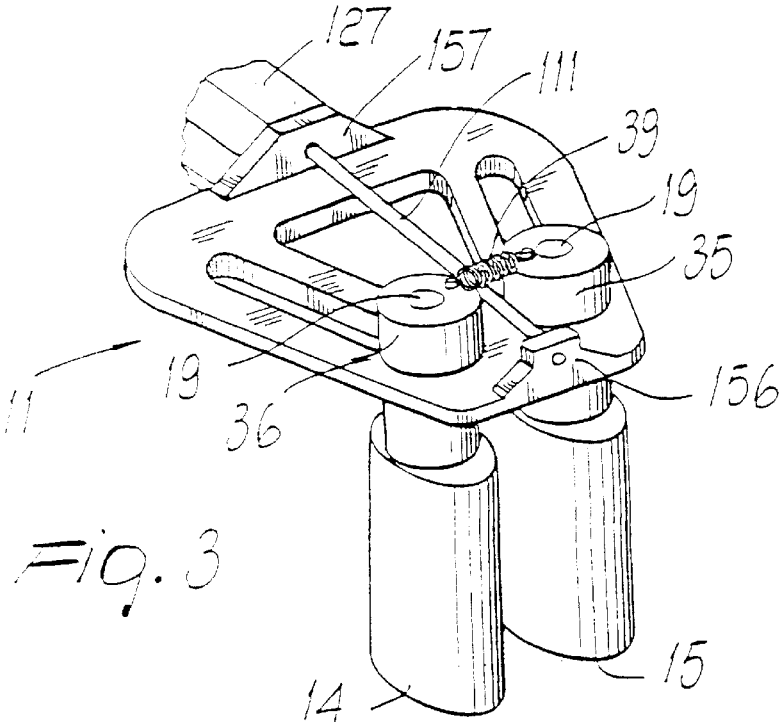
FIG. 3 is a front view of a clamping assembly showing the tension elements in idle or neutral position, wherein the slider was left out.

The tension elements (14, 15) are provided with extensions (35, 36) at the upper portion of the base plate (17), the extensions being interconnected by a spring means (39), such as for instance a coil-spring. A slider (155) is formed as a carriage and designed such as to be in engagement with both the extensions (35, 36). The slider (155) which consists essentially of a T-piece and enables simultaneous movement of the tension elements (14, 15). The tension elements (14, 15) can be easily moved from the idle position (refer to FIG. 3) into the traveled out position with enlarged gap width (refer to FIG. 4) for accommodating the workpiece, by moving the slide. Once the workpiece is placed between the tension elements (14, 15) in the so enlarged gap (28), the positioning and adjusting of same occurs automatically, namely by simply releasing the slider (155). Namely the restoration force acting between the tension elements and based on the previous expansion of the spring means (39) causes a movement of the same to one another and back towards the idle position such that the tension elements contact the workpiece. The lateral force exerted in the working position (FIG. 4) by the tension elements (14, 15), based on the effect of the spring on the workpiece, ensures in addition that the tension elements (14, 15) are subject to sufficient frictional force, irrespective of the surface structure of the object to be clamped, such that the workpiece is securely clamped between the tension elements (14, 15).

In order to achieve accurate positioning of the slider (155) relative to the tension elements (14, 15) the slider is preferably secured to a guiding means (111). The guiding means (111) can be implemented, for instance, as a guiding rod (111) which runs parallel to the longitudinal axis of the ground plate and on which a perforated slider (155) slides, or (see FIG. 7) by a guide slot (37) in which a slider engages with an extension (40).

The second clamping assembly (12) comprises a bracket (21) which is secured to a rod (13) and which extends outwardly therefrom. Preferably the rod (13) is screwed to a pedestal (127) which extends from an elevation (157) of the base plate (17). However, the connection of the rod (13) to the base plate (17) may be realized with any other kind of detachable connection. The bracket (21) is provided with a threaded bore (22) at a lower end thereof and receives a threaded spindle (23). The steel plate (24) is rotatably attached to the threaded spindle by a ball and socket joint (25) The other end of the treaded rod is connected to a handle (26).

The second clamping assembly (12) is arranged such that rotation of the handle (26) imparts a linear movement. This movement occurs towards or away from the first clamping assembly (11).

Figure 4:
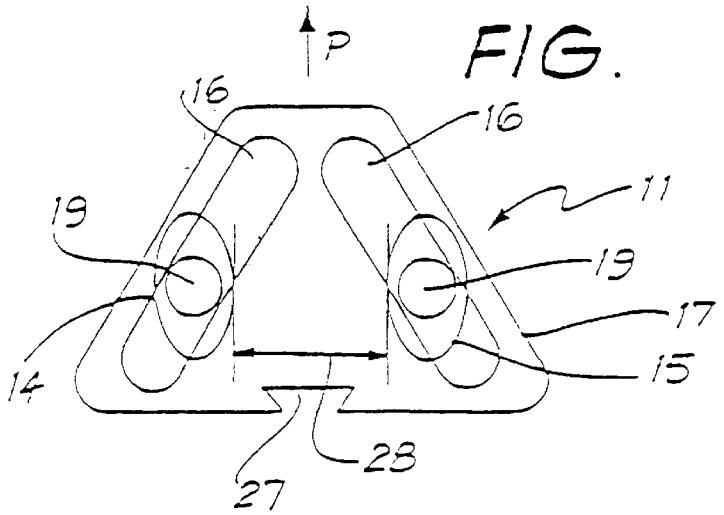
FIG. 4 is a schematic bottom view of the clamping assembly of FIG. 3 showing the tension elements in the working clamping position, wherein the workpiece was left out.
Figure 5:
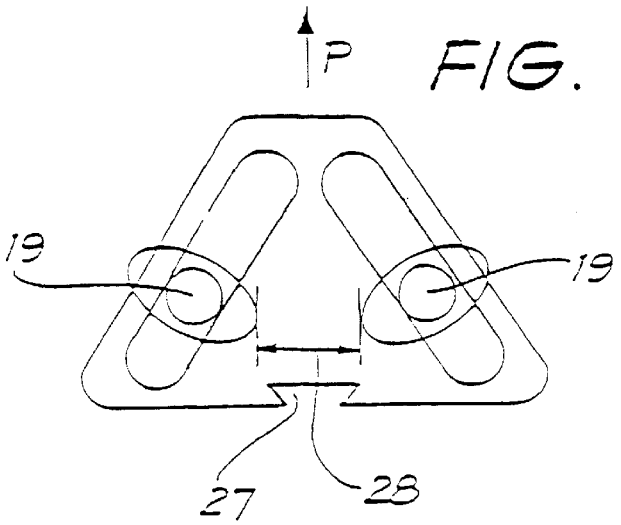
FIG. 5 is a schematic view of the clamping assembly of FIG. 4, depicting the tension elements being clearly rotated after clamping of the (not shown) workpiece by actuating the threaded spindle.

FIGS. 4 and 5 schematically illustrate the clamping action of the first clamping assembly (11).

The workpiece is brought in position in the gap (28) existing between the tension elements (14, 15), as previously described, whereat the tension elements (14, 15) spontaneously move, after release of the slider (34 or 35), into the working position (FIG. 4) resulting in adjusting and positioning at the workpiece. Thus, the tension elements (14, 15) assisted by forces generated by the spring firmly clamp the workpiece into position, whereby the further handling is simplified.

Furthermore, the tension elements (14, 15) are shaped such that the rotation of the same from a first position (FIG. 4) to a second position (as shown in FIG. 5) results in a decrease of the distance between the tension elements (14, 15), regardless of the position of the same within the oblong holes (16). This occurs because the radial distance from the axis (19) (which is the axis of rotation of the head part (18)) to the edge of the peripheral face is not constant, since this distance varies depending on the angle at which the radius is measured. In this way rotation of one of the tension elements (14, 15) causes a change in the radial distance from the axis of rotation to the edge of the peripheral surface of the tension elements (14, 15). Thus, the width of the gap (28) will be changed independently from the distance between the centers of the tension elements (14, 15).

To enable this change of gap width (28) to occur on rotation of the tension elements (14, 15), as in the embodiment of FIGS. 4 to 5, the tension elements (14, 15) are shaped as oval cylinders.

When the tension elements (14, 15) take in the working position (FIG. 4), i.e. when they are adjusted at the workpiece in clamping contact therewith, the tension elements are arranged in the first position. Due to the frictional forces between the tension elements (14, 15) and the workpiece, a force acting on the workpiece in the direction of arrow P causes a corresponding force to be applied to the tension elements (14, 15). The magnitude of this force is dependent on the relative coefficient of friction between the two surfaces, and as such is dependent on the surface characteristic of the tension elements (14, 15) and the workpiece. Furthermore, the magnitude of the force is dependent on the amount of force being applied by the tension elements (14, 15) on the workpiece in a direction towards the contact surface. Prior to the actual clamping process, i.e. once the tension elements (14, 15) are in contact with the workpiece in the working position (FIG. 4), this force is provided by the spring means (39). The workpiece is thus securely clamped between the tension elements (14, 15).

Subsequently, the second clamping assembly (12) is brought to bear against the workpiece which is placed in the gap (28) between the tension elements (14, 15) in order to generate a force to the workpiece. The second clamping assembly (12) does generate the force required to move the workpiece in the direction of the arrow P, whereby the clamping action of the clamp (10) is completed by the second clamping assembly (12).

When, by the actuation of the threaded spindle (23), a relative movement of the clamping assemblies (11, 12) towards each other occurs to generate a movement of the workpiece in the direction of arrow P, the force acting on the tension elements (14, 15)—merely generated until this point by the restoration action of the spring (39)—increases and leads to a corresponding movement of the tension elements (14, 15). In a first stage the tension elements (14, 15) are effectively dragged by the movement of the workpiece causing, to a certain extent, the tension elements to slide in the converging oblong holes (16) in the same direction as movement of the workpiece. As the oblong holes (16) converge, the width of the gap between the tension elements (14, 15) becomes smaller, and therefore the effect of the force on the contact surface increases.

This sliding action of the tension elements continues until there is sufficient force acting on the contact surface between the workpiece and the tension elements (14, 15) to cause the tension elements (14, 14) to rotate. As the tension elements rotate from the first position towards the second position (FIG. 5), the force imparted by the tension elements (14, 15) on the workpiece increases until a further movement of the workpiece in the direction of arrow P becomes impossible. At this stage the workpiece is securely clamped between first and second clamping assemblies (11, 12).

As stated above, the initial force on the tension elements (14, 15) imparted by movement of the workpiece in the direction of arrow P is dependent, in part, on the coefficient of friction. Consequently, the tension elements (14, 15) are provided with a skidproof "non-slip" material on their outer surface to ensure a relatively high coefficient of friction. Furthermore, to protect the workpiece from damage during clamping, the tension elements are formed at their peripheral face from a relatively flexible material. This flexible property of the material results in an increased contact surface of the tension elements (14, 15), since these are deformed, specially due to the action of force.

The increase of the contact surface of the tension elements (14, 15) does result in greater frictional forces between the workpiece and the tension elements (14, 15).

Figure 6:
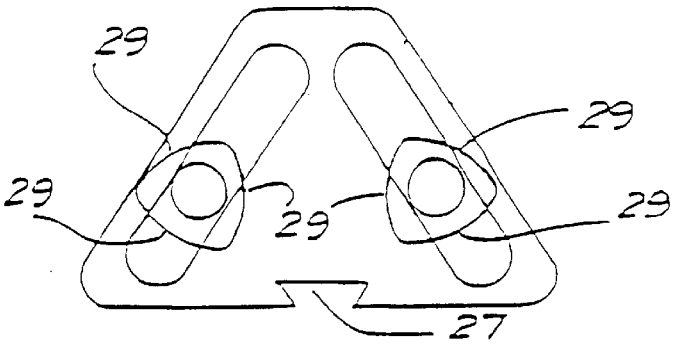

An alternative shape of the tension elements (14, 15) is shown in FIG. 6 wherein the head parts (18) have the shape of a modified three-cornered rod. To ensure that rotation of the head part (18) from the first to the second position causes a reduction in the width of the gap (28), each of the peripheral faces is curved from one edge to the opposite edge. By using a head piece having such a shape, each surface can be made from a respectively different material having different adherence or grip characteristics.

In order counteract to the spreading of the tension elements (14, 15) under force action, it is further preferred to form the tension elements (14, 15), in their longitudinal direction, as a downwardly widening cone, whereby the opening angle is between 1 to 2 degrees, preferably 1.5 degrees. This feature constitutes a further advantageous aspect of the present invention which may be realized by itself or in conjunction with the other features of the present invention.

In the embodiment as shown in FIGS. 1 and 2, the second clamping assembly (12) is the one to impart this predetermined movement on the workpiece by virtue of movement of the steel plate (24) towards the first clamping assembly (11).

Figure 7:
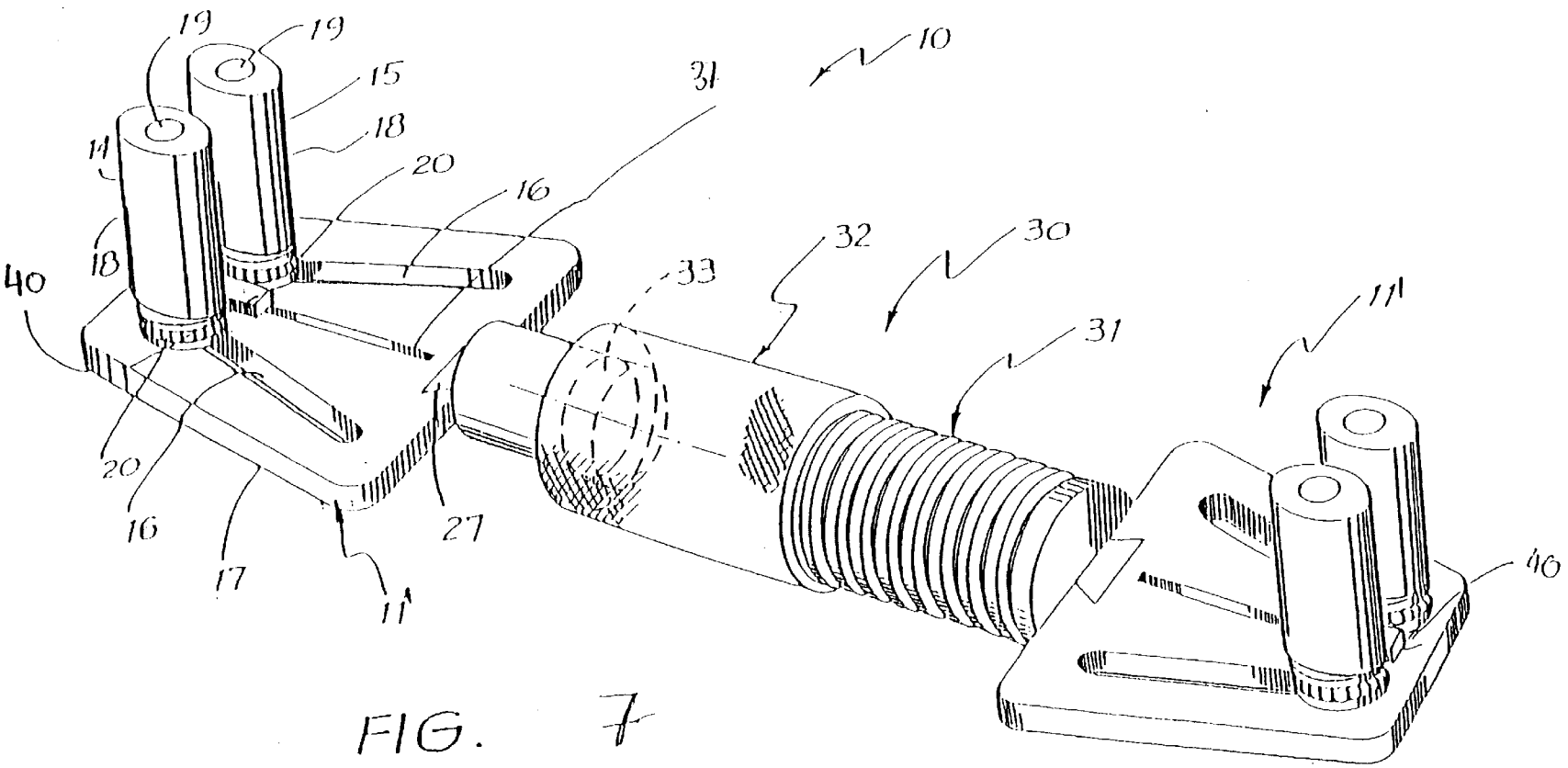
FIG. 7 is a bottom view of a further embodiment having a first and second identical clamping assembly.

In a second embodiment, which is disclosed in FIG. 7, two of the described first clamping assemblies (11) form similar clamping assemblies (11', 11') which are interconnected and form a complete clamp. The action of these clamping assemblies (11') is identical to that described above. The automatic positioning and the automatic adjustment of the tension elements of both clamping assemblies is of particular advantage in this embodiment, as the user is able to attach the clamp to the workpiece with one movement of the hand. A separate positioning and adjusting of the both clamping assemblies is no longer necessary, as the tension elements (14, 15) of both clamping assemblies (11', 11') automatically clamp the workpiece therebetween, as for the above described effect of the spring means (39).

In this embodiment the required predetermined movement of the workpiece, and thus the tensioning between both clamping assemblies (11', 11'), is achieved by varying the distance between the two clamping assemblies (11', 11'). The varying of the distance is made possible by a coupling element (30) interconnecting both clamping assemblies (11', 11'). The coupling element (30) is comprised firstly of a threaded spindle (31) removably connected to one of the clamping assemblies, and secondly of a sleeve (32) with an inner thread which receives the threaded spindle (31). The sleeve (32) with the inner thread is releasably connected to the second clamping assembly (11) and is, however, rotatably seated about its own axis relative the second clamping assembly (11') by way of a thrust bearing (33). Rotation of the sleeve (32) imparts relative movement between the two clamping assemblies (11', 11') towards one another and away.

As will be apparent from the above description, the clamping assemblies (11 or 11') enable a very versatile clamp to be realized. Furthermore, as the clamping assemblies (11 and 11') are all detachable, the clamp can be converted from the embodiment shown in FIGS. 1 and 2 to that shown in FIG. 7. Furthermore, the tension elements (14, 15) are all detachable from the base plate (17) such that tension elements of different surface characteristics or of different shapes can be utilized.

With the novel, automatic positioning and adjustment system of the tension elements of clamping assembly (11 or 11'), the clamp in either embodiment can be used to clamp a whole range of different shaped workpieces. Included in this type of workplaces which can be clamped and then tensioned between the clamping assemblies are curved/bent workpieces, T-shaped pieces and workpieces which are of considerable length and are required to be connected end to end with one another.

Figure 9:
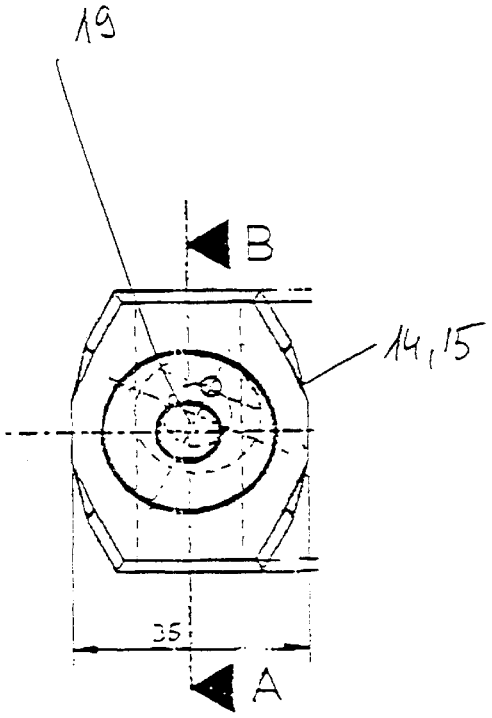
FIG. 9 is a bottom view of the tension elements (14, 15) of FIG. 8, wherein the contact surface of the tension element is faceted.
Figure 8:
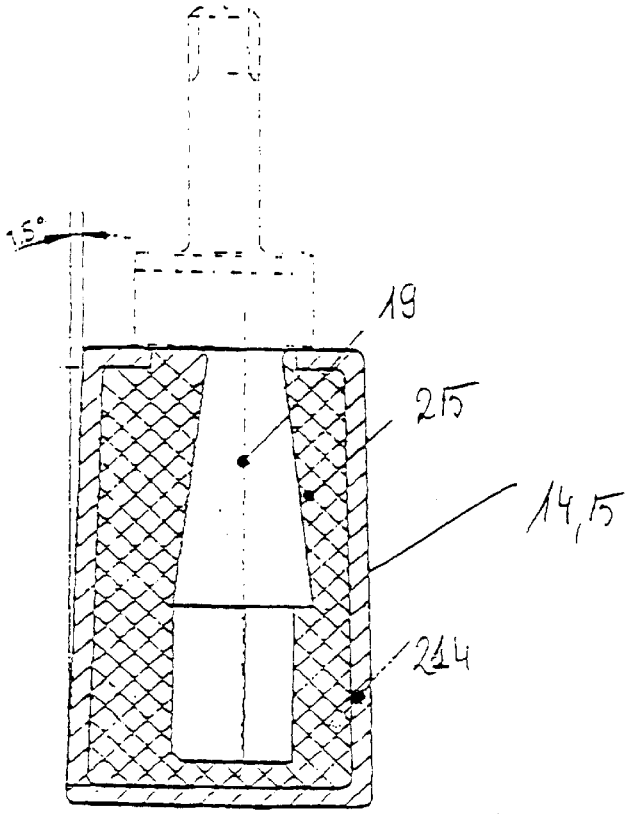

According to a further preferred embodiment of the clamp, as shown in FIGS. 8 and 9, the axles (19) of the tension elements (14, 15) are eccentrically positioned in respect to a central axis of the oblong holes (16), such that a rotation of the tension elements (14, 15) is caused. Due to the eccentricity of the axles (19) of the tension elements (14, 15) same do provide a crankshaft-effect, such that the rotation of the tension elements (14, 15) towards one an other is facilitated. Due to the eccentricity the gap between the tension elements (14, 15) is reduced automatically as a consequence of the force action.

Furthermore, in the embodiments of FIGS. 8 and 9, the contact surfaces of the tension elements (14, 15) are faceted, as emphasized particularly in FIG. 9. This ensures a better seat of the tension elements (14, 15) at the clamped workpiece.

According to a particularly advantageous aspect of the above described embodiment, the tension elements (14, 15) are provided with a softer outer coating (non-slip material) 214, whereby damages to the surface of the workpiece are avoided. The core 215 of the tension elements (14, 15) is made from a rigid material. The coefficient of friction of the coating (214) has a particular importance, as it should have a very high value in order to securely clamp workpieces with smooth surfaces.

In the embodiment as shown in FIGS. 8 and 9 the forces exerted are acting below the axis center.

Where technical features mentioned in any claim are followed by reference signs, those reference signs have been included just for the sole purpose of increasing intelligibility of the claims and accordingly, such reference signs do not have any limiting effect on the scope of each element identified by way of example by such reference signs.

What is claimed is:

1. A clamp having at least one clamping assembly comprising a base plate and a pair of tension elements, the base plate including a pair of oblong holes which converge towards a central line, each of the two tension elements being at least partially curved at its peripheral face, the peripheral face being made of a skidproof non-slip material, a respective tension element being mounted in a respective one of the two oblong holes and positioned such that its axis is substantially perpendicular to the base plate, the tension elements furthermore being arranged, such that the curved peripheral faces thereof are exactly opposed to each other, and the tension elements being slidable in their respective oblong holes by means of a slider, and wherein they are rotatably seated by means of ball bearings, each of the tension elements having a longitudinal axis about which to freely rotate, wherein a distance between both opposing peripheral faces of the tension elements can be varied by sliding thereof in the oblong holes, and the distance can also be varied by rotation of the tension elements via the ball bearings from a first position to a second position, each of the tension elements being conically shaped in a direction of the longitudinal axis associated therewith.

2. The clamp according to claim 1, further including a spring means being provided between the tension elements and which is tensioned by the movement of the tension elements in the direction of divergence of the oblong holes, wherein the spring means is provided by a coil-spring.

3. The clamp according to claim 2, characterized in that the coil-spring is attached between two extensions of the tension elements which protrude above an upper side of the base plate.

4. The clamp according to claim 3, characterized in that the slider is perforated, and in that a guiding rod for the slider is attached parallel to the base plate.

5. The clamp according to claim 3, characterized in that the slider is provided with an extension which is guided in a guide slot of the base plate.

6. The clamp according to claim 3, characterized in that the converging oblong holes form an angle of 40 degrees therebetween.

7. The clamp according to claim 3, characterized in that the tension elements are oval shaped in cross section, the cross section being perpendicular to the axis.

8. The clamp according to claim 3, characterized in that the tension elements are triangular shaped with curved surfaces in cross section, the cross section being perpendicular to the axis.

9. The clamp according to claim 3, characterized in that a peripheral face of the tension elements is formed from a flexible material.

10. The clamp according to claim 3, characterized in that the tension elements are detachable from the base plate.

11. The clamp according to claim 3, characterized in that the tension elements are formed, in a respective longitudinal direction, as a downwardly widening cone, the downwardly widening cone has an opening angle being between 1 to 2 degrees, preferably 1.5 degrees.

12. The clamp according to claim 3, characterized in that each longitudinal axis of the tension elements is positioned eccentrically in respect to a center of the oblong holes, to cause a rotation of the tension elements.

13. A clamp according to claim 3, characterized in that it includes a second clamping assembly which is slidably arranged on a polyhedral rod which is detachably connectable to the base plate.

14. The clamp according to claim 13, characterized in that it comprises the second clamping assembly connected to the first clamping assembly by means of a rod, the first and second clamping assemblies being movable relative to one another in a direction towards each other or away form each other, wherein in use the second clamping assembly is arranged to abut the workpiece and wherein by relative movement of the first towards the second clamping assembly a force is imparted on the workpiece to move same in the direction of convergence of the oblong holes.

15. The clamp according to claim 11, characterized in that the second clamping assembly comprises a bracket which is slidably mounted to the rod, the bracket having a threaded bore which receives a threaded spindle, one end of the threaded spindle supporting a steel plate which is arranged such as to bear against the workpiece.

16. The clamp according to claim 13, characterized in that the first and second clamping assemblies are interconnected by means of a coupling element which enables the relative movement of the first clamping assembly towards the second clamping assembly, wherein the movement moves the clamping assemblies towards and away from each other.

17. The clamp according to claim 16, characterized in that the coupling element is comprised of a threaded spindle which is received in a sleeve with inner thread, and wherein one of the clamping assemblies is connected to the threaded spindle and the second clamping assembly is connected to the sleeve with the inner thread, such as to rotate about its own axis, wherein this rotation causes a linear movement of both clamping assemblies relative to another.

18. The clamp according to claim 13, characterized in that the first clamping assembly is detachable from the second clamping assembly.

19. A clamp having at least one clamping assembly comprising a base plate and a pair of tension elements, the base plate including a pair of oblong holes which coverage towards a central line, a respective tension element being mounted in a respective one of the two oblong holes and positioned such as its axis is substantially perpendicular to the base plate, the tension elements being slidable in their respective oblong holes by means of a slider, wherein a distance between both opposing peripheral faces of the tension elements can be varied by sliding thereof in the oblong holes, characterized in that each of the tension elements is conically shaped in a direction of a longitudinal axis associated therewith.

20. A clamp having at least one clamping assembly comprising a base plate and a pair of tension elements, the base plate including a pair of oblong holes which converge towards a central line, a respective tension element being mounted in a respective one of the two oblong holes and positioned such as its axis is substantially perpendicular to the base plate, the tension elements being slidable in their respective oblong holes by means of a slider, wherein a distance between both opposing peripheral faces of the tension elements can be varied by sliding thereof in the oblong holes, characterized in that the contact surfaces of the tension elements are faceted.

21. The clamp according to claim 1, characterized in that the non-slip material on the peripheral faces of the tension elements are flexible.

22. A clamp having at least one clamping assembly comprising: a base plate and a pair of tension elements, the base plate including a pair of oblong holes which converge towards a central line, each of the two tension elements being fully or partially curved at its peripheral face, the peripheral face being made of a skidproof non-slip material, a respective tension element being mounted in a respective one of the two oblong holes and positioned such as its axis is substantially perpendicular to the base plate, the tension elements furthermore being arranged, such that the curved peripheral faces thereof are exactly opposed to each other, and the tension elements being slidable in their respective oblong holes by means of a slider, and wherein they are rotatably seated by means of ball bearings, each of the tension elements having a longitudinal axis about which to freely rotate, wherein a distance between both opposing peripheral faces of the tension elements can be varied by sliding thereof in the oblong holes, and the distance can also be varied by rotation of the tension elements via the ball bearings from a first position to a second position, the contact surfaces of the tension elements are faceted, a spring means being provided between the tension elements which is tensioned by the movement of the tension elements in a direction of divergence of the oblong holes.

23. A clamp having at least one clamping assembly comprising: a base plate and a pair of tension elements, the base plate including a pair of oblong holes which converge towards a central line, a respective tension element being mounted in a respective one of the two oblong holes and positioned such as its axis is substantially perpendicular to the base plate, the tension elements being slidable in their respective oblong holes by means of a slider, wherein a distance between both opposing peripheral faces of the tension elements can be varied by sliding thereof in the oblong holes, each of the tension elements being conically shaped in a direction of a longitudinal axis associated therewith.

* * * * *